US005609169A

United States Patent [19]

Yang

[11] Patent Number: 5,609,169

[45] Date of Patent: Mar. 11, 1997

[54] HAIR CLIP

[76] Inventor: I-Chien Yang, P.O. Box 82-144, Taipei, Taiwan

[21] Appl. No.: 574,282

[22] Filed: Dec. 18, 1995

[51] Int. Cl.[6] ..... A45D 8/32; A45D 8/24

[52] U.S. Cl. ..... 132/279; 132/282

[58] Field of Search ..... 132/276, 278, 132/279, 280, 281, 282

[56] References Cited

U.S. PATENT DOCUMENTS

| | | | |
|---|---|---|---|
| 1,806,248 | 5/1931 | Freeman et al. | 132/279 |
| 2,141,368 | 12/1938 | Solomon | 132/279 |
| 2,813,533 | 11/1957 | Fay | 132/279 |
| 3,998,233 | 1/1989 | Dorr | 132/279 |
| 4,991,607 | 2/1991 | Chen | 132/279 |
| 5,109,878 | 5/1992 | Kuo-Hua | 132/278 |
| 5,165,430 | 11/1992 | Portor | 132/278 |
| 5,284,167 | 2/1994 | Gill | 132/279 |
| 5,398,705 | 3/1995 | Hiltbrand et al. | 132/279 |

FOREIGN PATENT DOCUMENTS

| | | | |
|---|---|---|---|
| 815825 | 10/1951 | Germany | 132/279 |
| 121213 | 6/1927 | Switzerland | 132/279 |
| 846338 | 8/1960 | United Kingdom | 132/279 |

*Primary Examiner*—Paul J. Hirsch
*Attorney, Agent, or Firm*—Alfred Lei

[57] ABSTRACT

A hair clip which includes a clip base and a clamping leaf with a finger strip at one end, wherein the clamping leaf has two hollow cylindrical coupling portions at two opposite ends, each hollow cylindrical coupling portion having a longitudinal mouth and projection at one side of the mouth; the clip base has two transverse coupling rods at two opposite ends respectively forced into the mouth of the clamping leaf, each transverse coupling rod having a coupling groove for engagement with the projection of the respective hollow cylindrical coupling portion.

1 Claim, 5 Drawing Sheets

HAIR CLIP

BACKGROUND OF THE INVENTION

1. Field of the Invention

This invention relates to hair clips, and relates more particularly to such a hair clip which comprises a clip base having male coupling portions, and a clamping leaf having female coupling portions detachably pivotably coupled to the male coupling portions of the clip base.

2. Description of the Prior Art

Regular hair clips are commonly comprised of a metal clip base, a metal clamping leaf having a fixed end pivoted to one end of the metal clip base, and a metal retainer fixedly secured to the clip base metal for holding down the free end of the metal clamping leaf. Because the parts of this structure of hair clip are made from metal, they tend to rust under the beating of the weather. When in use, the user's hands tend to be injured by the edges of the metal parts. Because the metal retainer is separately made and then fixed to the metal clip base, it tends to fall out of place after a long use. Furthermore, the complicated assembly process of this structure of hair clip greatly increases the manufacturing cost.

SUMMARY OF THE INVENTION

This invention is designed to provide a hair clip which eliminates the aforesaid drawbacks.

According to the preferred embodiment of the present invention, the hair clip comprises a clip base and a clamping leaf respectively molded from plastics. The clamping leaf has two hollow cylindrical coupling portions at two opposite ends, each hollow cylindrical coupling portion having a longitudinal mouth and projection at one side of the mouth. The clip base has two transverse coupling rods at two opposite ends respectively forced into the mouth of the clamping leaf, each transverse coupling rod having a coupling groove for engagement with the projection of the respective hollow cylindrical coupling portion. Because the clip base and the clamping leaf are respectively molded from plastics and then coupled together by fastening the respective hollow cylindrical coupling portions to the respective transverse coupling rods, the assembly process of the hair clip is simple, and the manufacturing cost thereof is low. Because the clip base and the clamping leaf are respectively molded from plastics, the smooth surfaces of the clip base and the clamping leaf do not hurt the hands. The clip base may be made with ornament mounting holes for mounting any of a variety of ornaments. Furthermore, the clamping leaf has a finger strip at one end. By bending the finger strip outwards from the clip base, the corresponding hollow cylindrical coupling portion of the clamping leaf is disengaged from the respective transverse coupling rod of the clip base.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
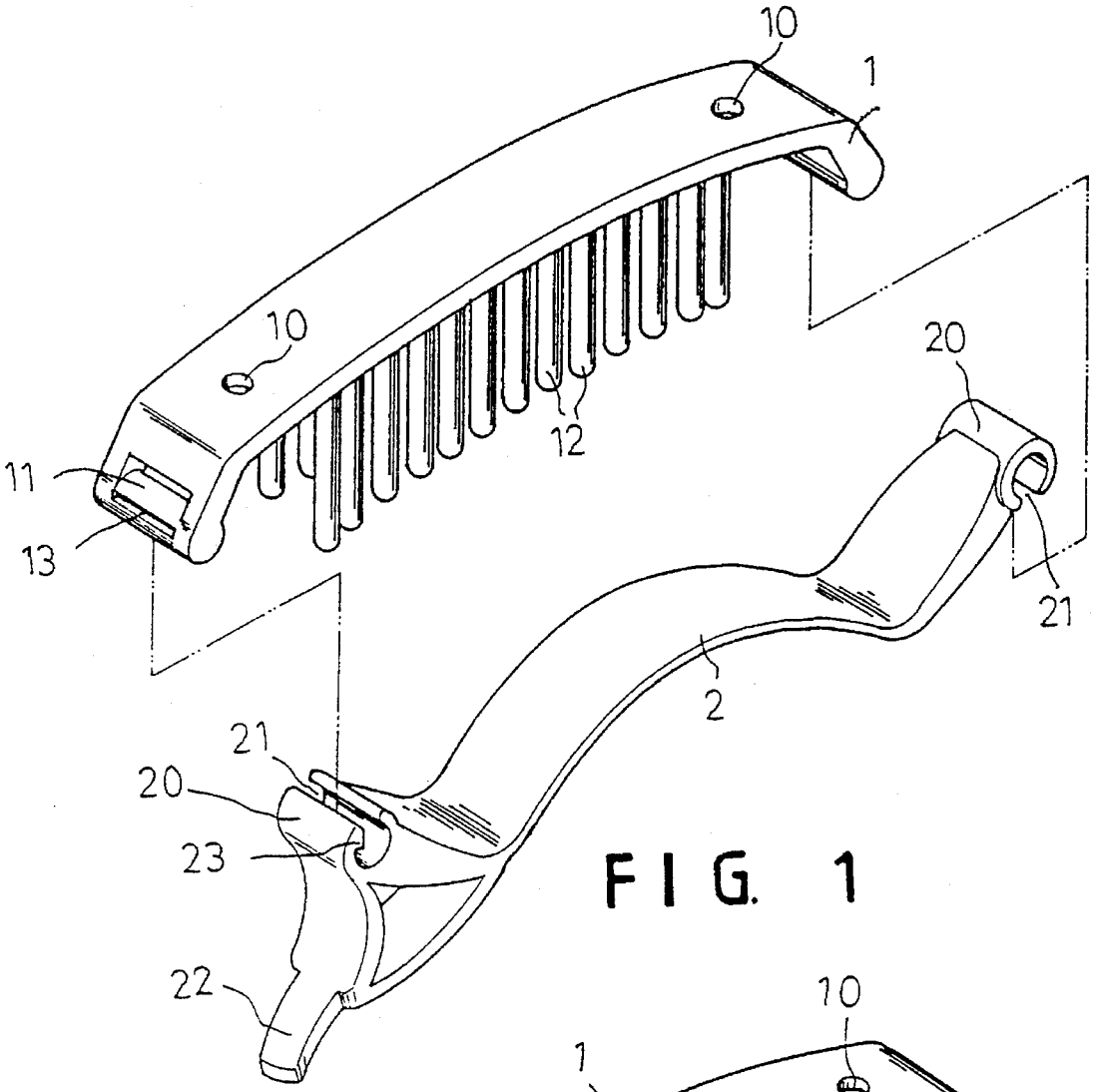
FIG. 1 is an exploded view of a hair clip according to the present invention.
Figure 2:
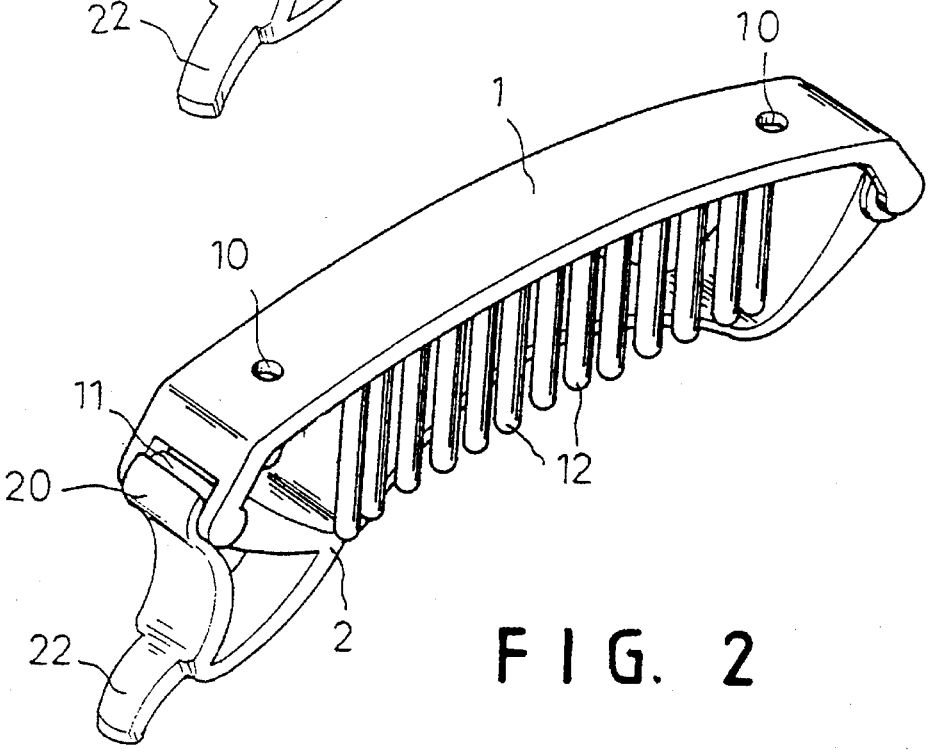
FIG. 2 is an elevational view of the hair clip shown in FIG. 1.
Figure 3A:
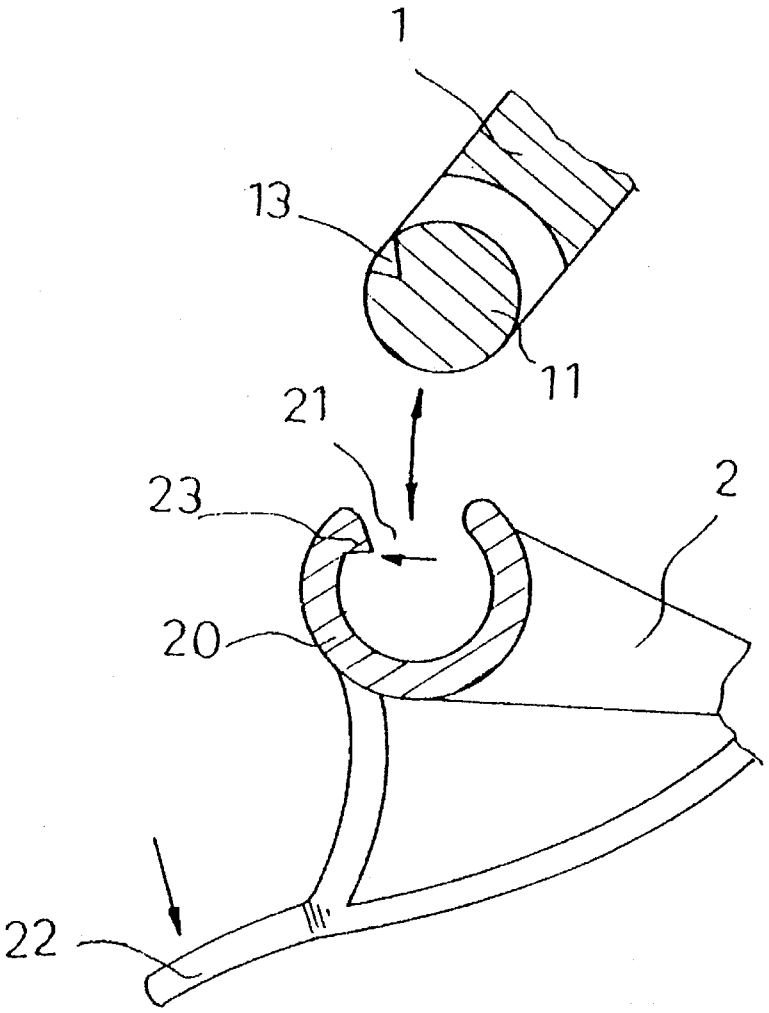
FIG. 3A is a sectional view in an enlarged scale of the left part of FIG. 1.
Figure 3B:
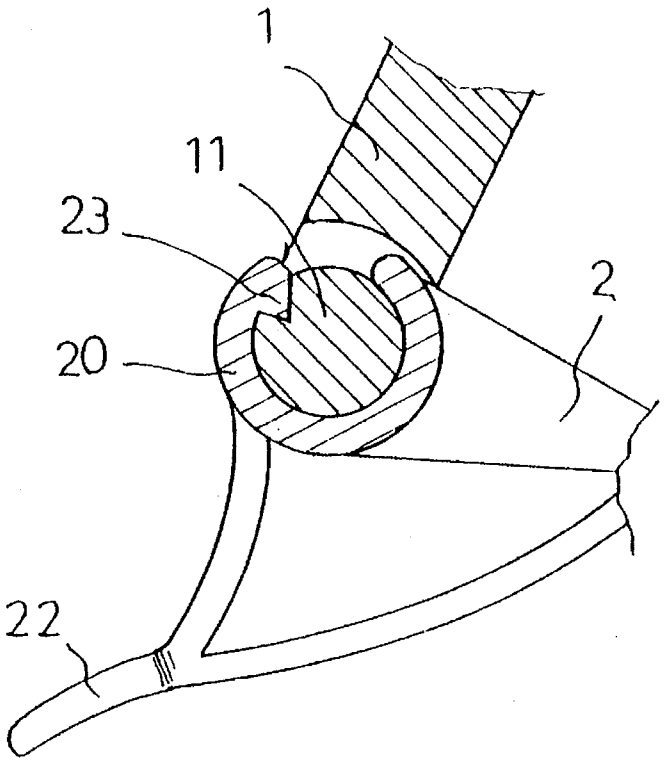
FIG. 3B shows the coupling rod of the clip base forced into engagement with the respective hollow cylindrical coupling portion of the clamping leaf according to the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Referring to FIGS. 1, 2, 3A, 3B, 4A, a hair clip in accordance with the present invention is generally comprised of a clip base 1, and a clamping leaf 2. The clip base 1 and the clamping leaf 2 are preferably molded from plastics. The clip base 1 is made of elongated, slightly arched shape, having two transverse coupling rods 11 at two opposite ends, each coupling rod 11 having a coupling groove 13, two ornament mounting holes 10 respectively disposed adjacent to the transverse coupling rods 11, and a plurality of downward pins 12 perpendicularly extended from the inner side thereof. The clamping leaf 2 comprises two hollow cylindrical coupling portions 20 at two opposite ends, and an outward finger strip 22 extended from one hollow cylindrical coupling portion 20. Each of the hollow cylindrical coupling portions 20 has a mouth 21 through the length, and a longitudinal projection 23 along one side of the mouth 21. The mouths 21 of the hollow cylindrical coupling portions 20 are disposed in reversed directions. When the coupling rods 11 of the clip base 1 are forced into the mouths 21 of the clamping leaf 2, the longitudinal projections 23 of the hollow cylindrical coupling portions 20 are forced into engagement with the coupling grooves 13 of the coupling rods 11, and therefore the coupling rods 11 of the clip base 1 are respectively coupled to the hollow cylindrical coupling portions 20 (see FIGS. 3A and 3B).

Figure 4A:
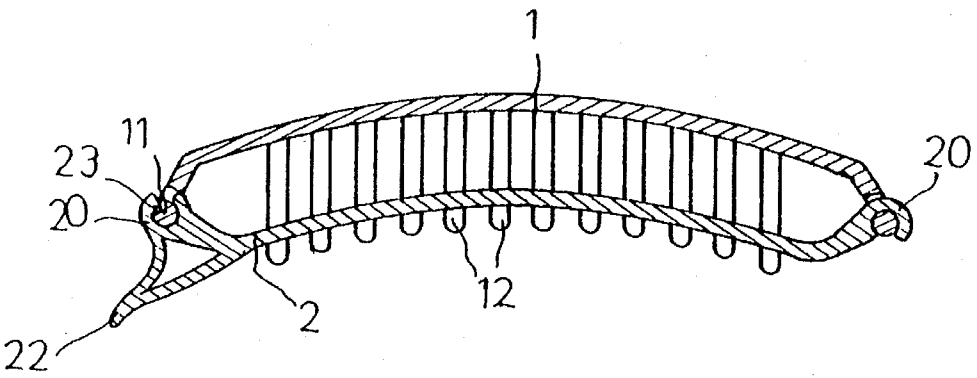
FIG. 4A is a sectional view showing the hair clip closed according to the present invention.
Figure 4B:
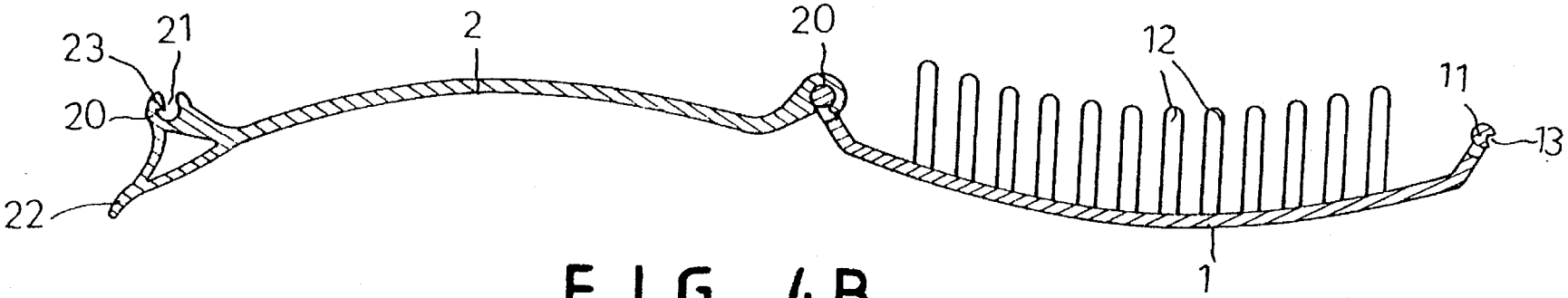
FIG. 4B is a sectional view showing the hair clip opened according to the present invention.

Referring to FIG. 4B and FIG. 4A again, by pulling the finger strip 22 outwards, the corresponding end of the clamping leaf 2 is disconnected from the clip base 1, and therefore the hair clip can be fastened to the hair, permitting the hair to be held between the clip base 1 and the clamping leaf 2.

Figure 5:
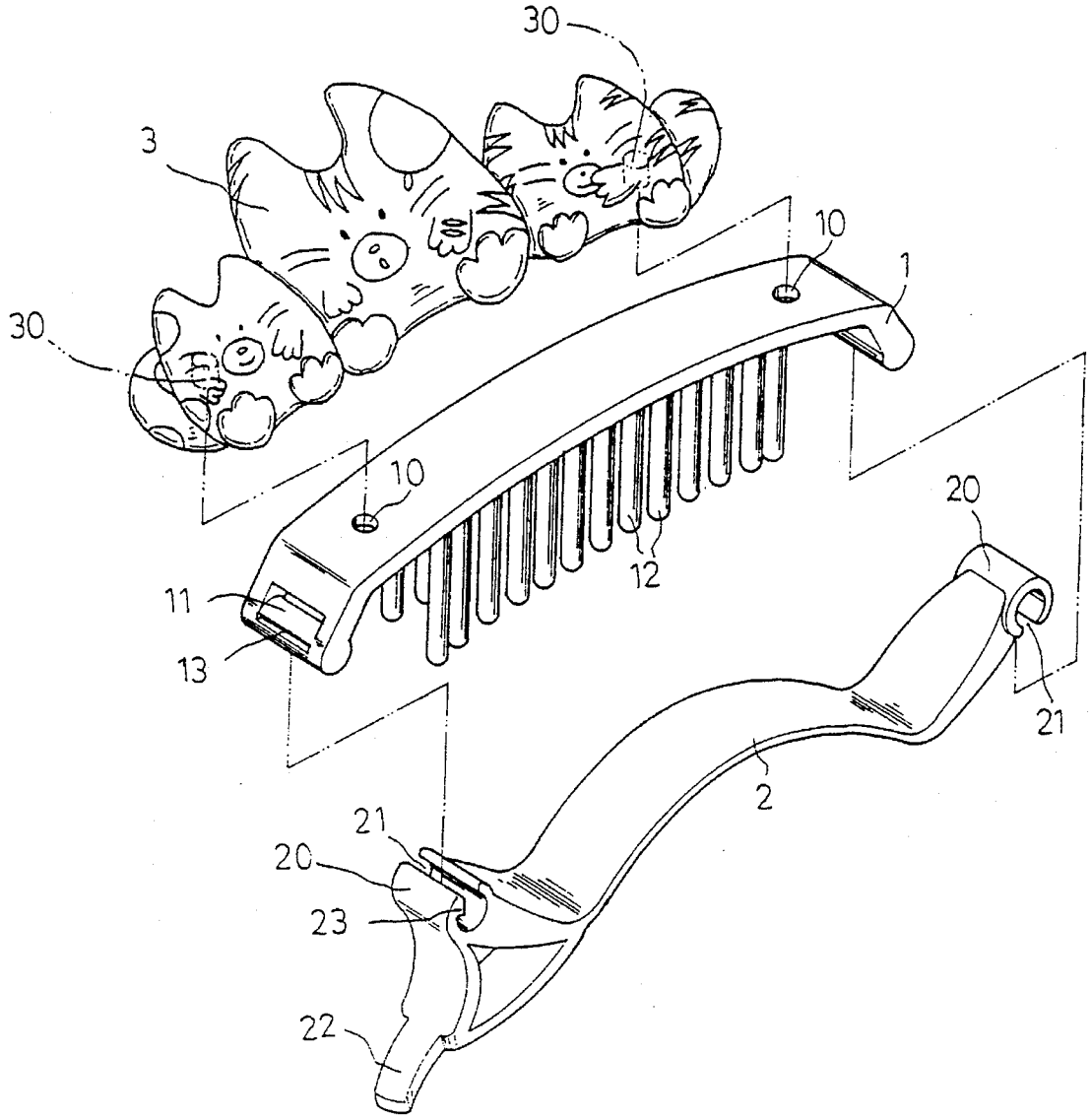
FIG. 5 shows the positioning of an ornament on the clip base according to the present invention.
Figure 6:
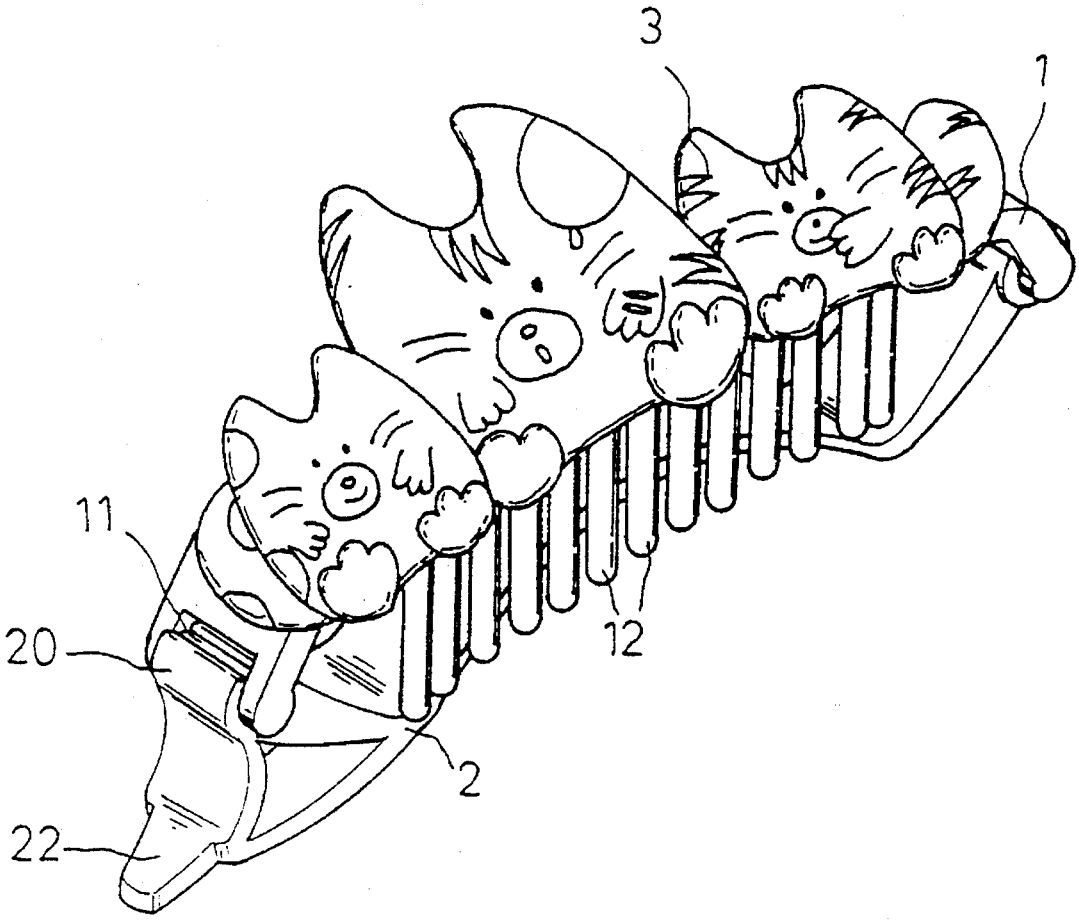
FIG. 6 is an assembly view of FIG. 5.

Referring to FIGS. 5 and 6, the ornament, referenced by 3, has two bottom pins 30 near two opposite ends. By fitting the bottom pins 30 into the ornament mounting holes 10, the ornament 3 is fixed to the clip base 1. The ornament 3 may be variously embodied to match with the user's dressing.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A hair clip comprising a clip base and a clamping leaf, wherein said clip base has two integral male coupling portions at two opposite ends, said clamping leaf having two integral female coupling portions respectively pivotably coupled to the male coupling portions of said clip base, the female coupling portions of said clamping leaf having a respective mouth disposed in reversed directions for coupling to the male coupling portions of said clip base, and a respective projection at one side of the respective mouth for engagement with a respective groove of the corresponding male coupling portion, said clamping leaf having an outward finger strip at one end for pulling by hand to disengage the adjacent female coupling portion from the respective male coupling portion.

* * * * *